US007694446B1

(12) United States Patent
Bea

(10) Patent No.: US 7,694,446 B1
(45) Date of Patent: Apr. 13, 2010

(54) MODULAR PICTURE FRAME APPARATUS

(76) Inventor: Tammie Bea, 1858 Fair Ave., Honesdale, PA (US) 18431

( * ) Notice: Subject to any disclaimer, the term of this patent is extended or adjusted under 35 U.S.C. 154(b) by 0 days.

(21) Appl. No.: 12/191,355

(22) Filed: Aug. 14, 2008

(51) Int. Cl.
*G09F 7/18* (2006.01)
*A47G 1/06* (2006.01)

(52) U.S. Cl. ..... 40/605; 40/730

(58) Field of Classification Search ..... 40/605, 40/611.06, 611.08, 611.07, 618, 730, 829
See application file for complete search history.

(56) References Cited

U.S. PATENT DOCUMENTS

| | | | | |
|---|---|---|---|---|
| 2,919,512 | A | 1/1960 | McDonald | |
| 3,642,144 | A * | 2/1972 | Brooks | 211/45 |
| 3,965,600 | A | 6/1976 | Paskerian | |
| 4,905,389 | A | 3/1990 | Bisconti | |
| 5,189,822 | A * | 3/1993 | Schmanski et al. | 40/611.05 |
| D340,811 | S | 11/1993 | Vaughan | |
| 5,437,116 | A * | 8/1995 | Hardy | 40/605 |
| 5,961,090 | A | 10/1999 | Parkin | |
| 6,286,802 | B1 | 9/2001 | Munson et al. | |
| 6,962,016 | B1 | 11/2005 | Meyer | |
| 2006/0070892 | A1 | 4/2006 | Benson | |

* cited by examiner

*Primary Examiner*—Cassandra Davis

(57) ABSTRACT

A modular picture frame apparatus includes a plurality of housings. Each of the housings is configured to removably receive at least one picture. Each of the housings has a panel with a first edge, a second edge, a third edge, and a fourth edge. The first and second edges are positioned opposite of each other. A back side of the panel includes at least one mounting member to facilitate the mounting of the panel on a wall. An upper flange is attached to a front side of the panel adjacent to the first edge. A lower flange is attached to the front side adjacent to the second edge. Each of the upper and lower flanges has an elongated slot therein. A picture is positionable in the slots in the upper and lower flanges. At least one coupler removably couples together two of the housings.

4 Claims, 7 Drawing Sheets

MODULAR PICTURE FRAME APPARATUS

BACKGROUND OF THE INVENTION

Field of the Invention

The present invention relates to picture frame devices and more particularly pertains to a new picture frame device for receiving a plurality of pictures and which may be selectively expanded to hold additional pictures.

SUMMARY OF THE INVENTION

The present invention meets the needs presented above by generally comprising a plurality of housings. Each of the housings is configured to removably receive at least one picture. Each of the housings includes a panel having a first edge, a second edge, a third edge, and a fourth edge. The first and second edges are positioned opposite of each other and each of the third and fourth edges is positioned opposite of each other. The panel has a front side and a back side. The back side includes at least one mounting member to facilitate the mounting of the panel on a wall. An upper flange is attached to the front side adjacent to and coextensive with the first edge. A lower flange is attached to the front side adjacent to and coextensive with the second edge. Each of the upper and lower flanges has an elongated slot therein positioned adjacent to an associated front edge thereof. A picture is positionable in the slots in the upper and lower flanges to removably position the picture in front of the front side. At least one coupler for removably coupling together two of the housings is provided such that a third edge of one of the housings is abutted and attached to a fourth edge of another one of the housings.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
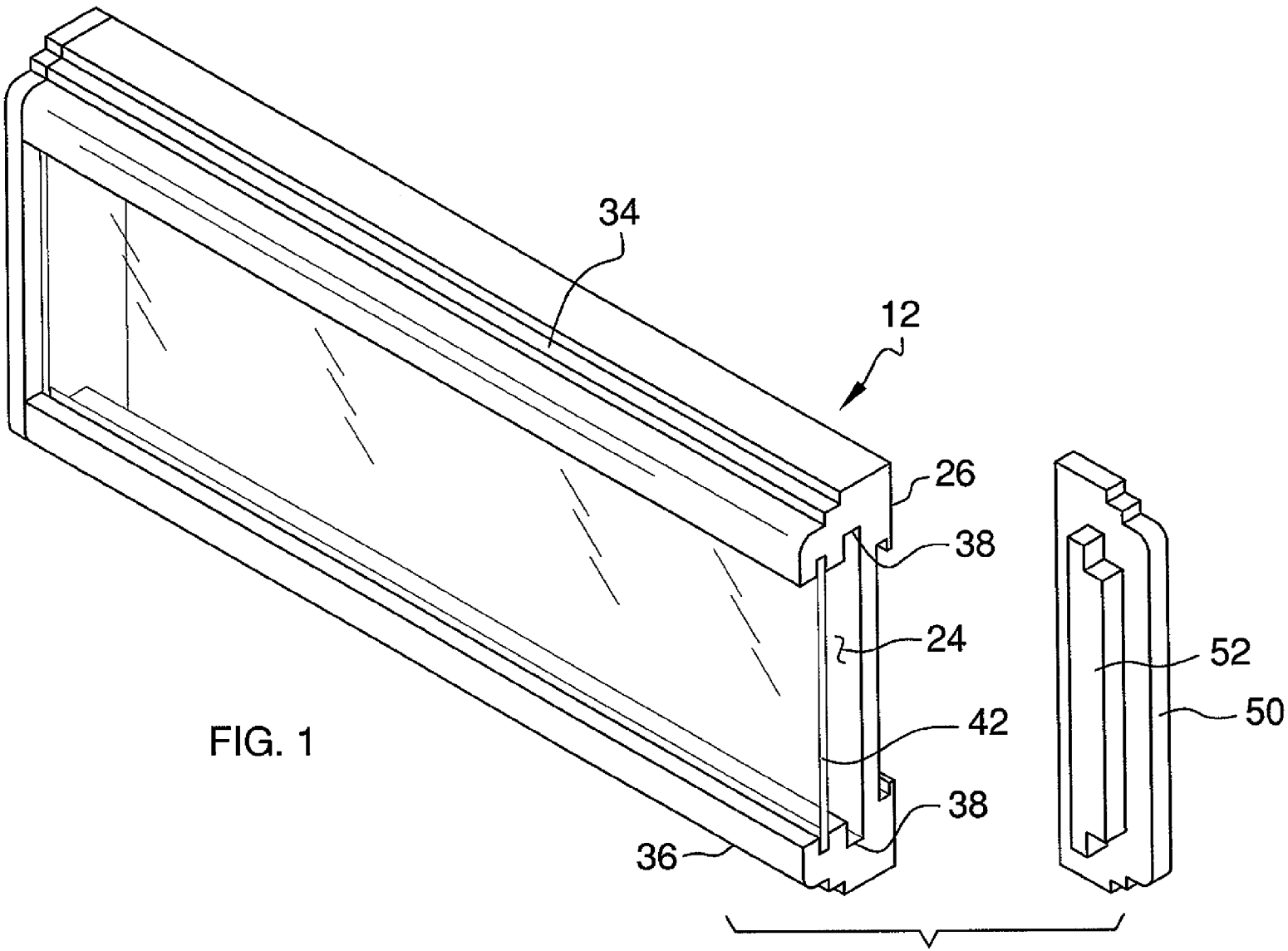
FIG. 1 is a front perspective view of a housing of a modular picture frame apparatus according to the present invention.
Figure 2:
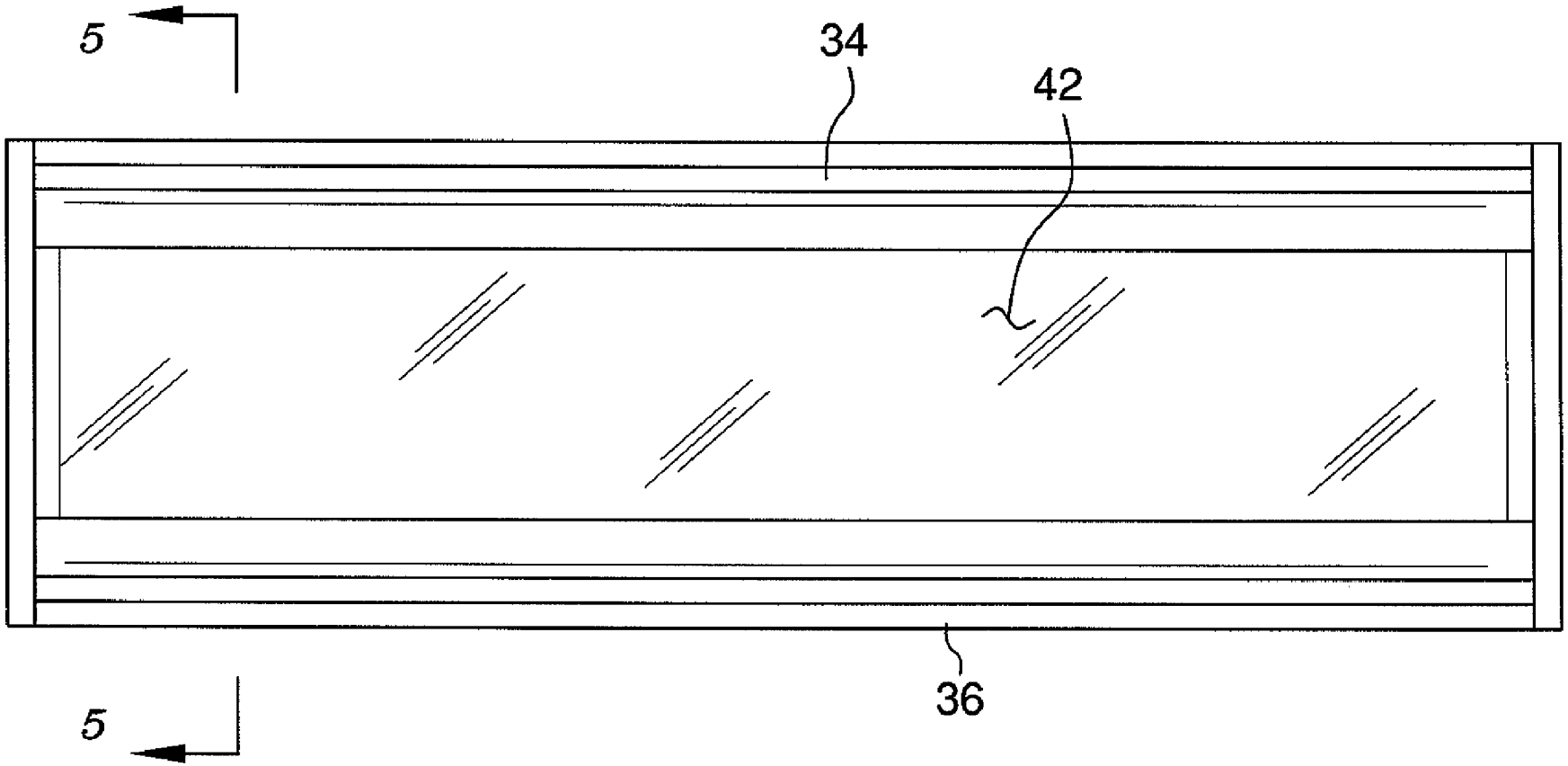
FIG. 2 is a front view of a housing of the present invention.
Figure 3:
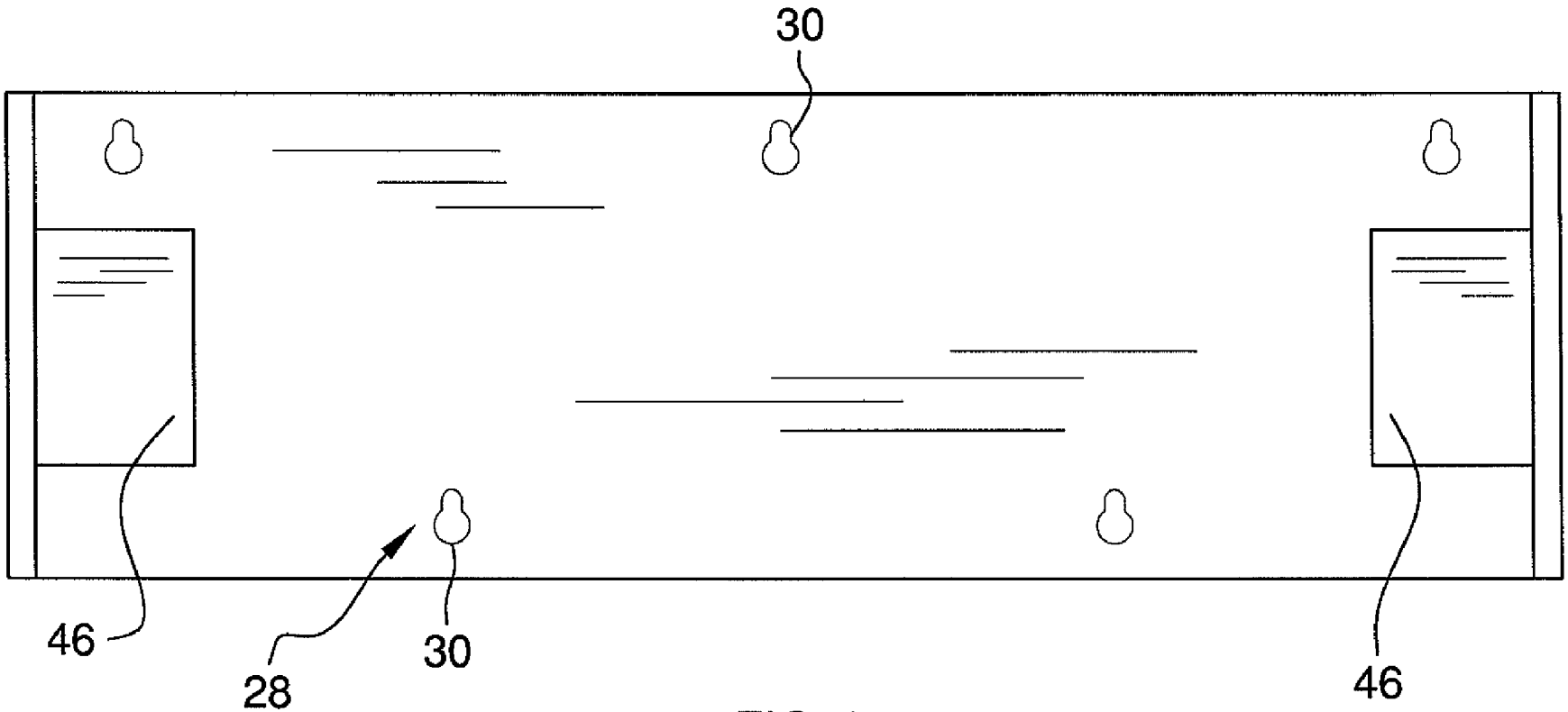
FIG. 3 is a back view of a housing of the present invention.
Figure 4:
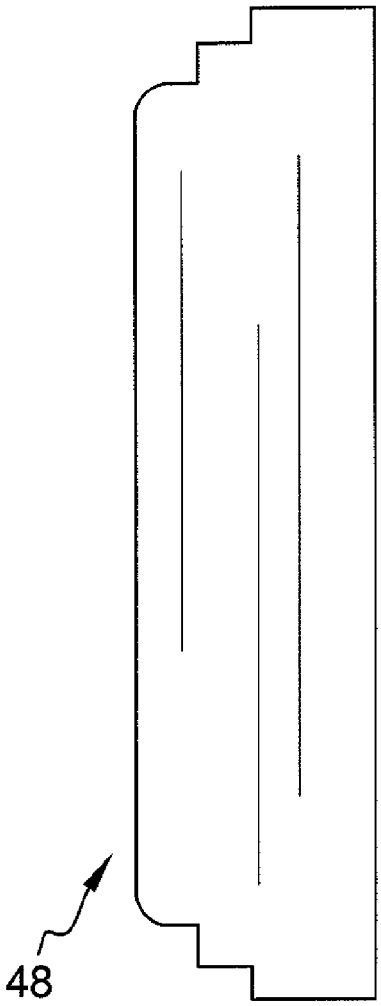
FIG. 4 is an end view of the present invention.
Figure 5:
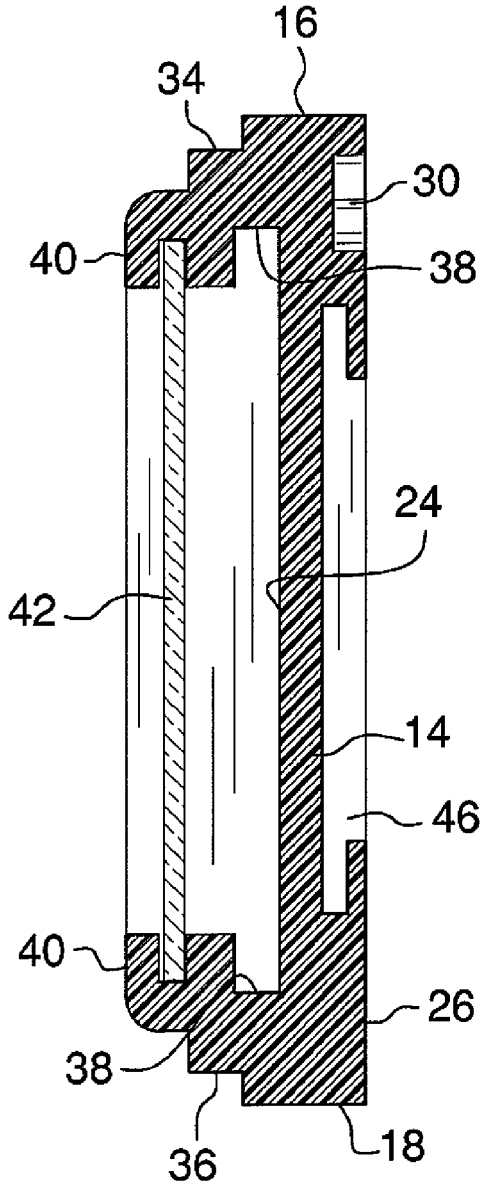
FIG. 5 is a cross-sectional view taken along line 5-5 of FIG. 2 of the present invention.
Figure 6:
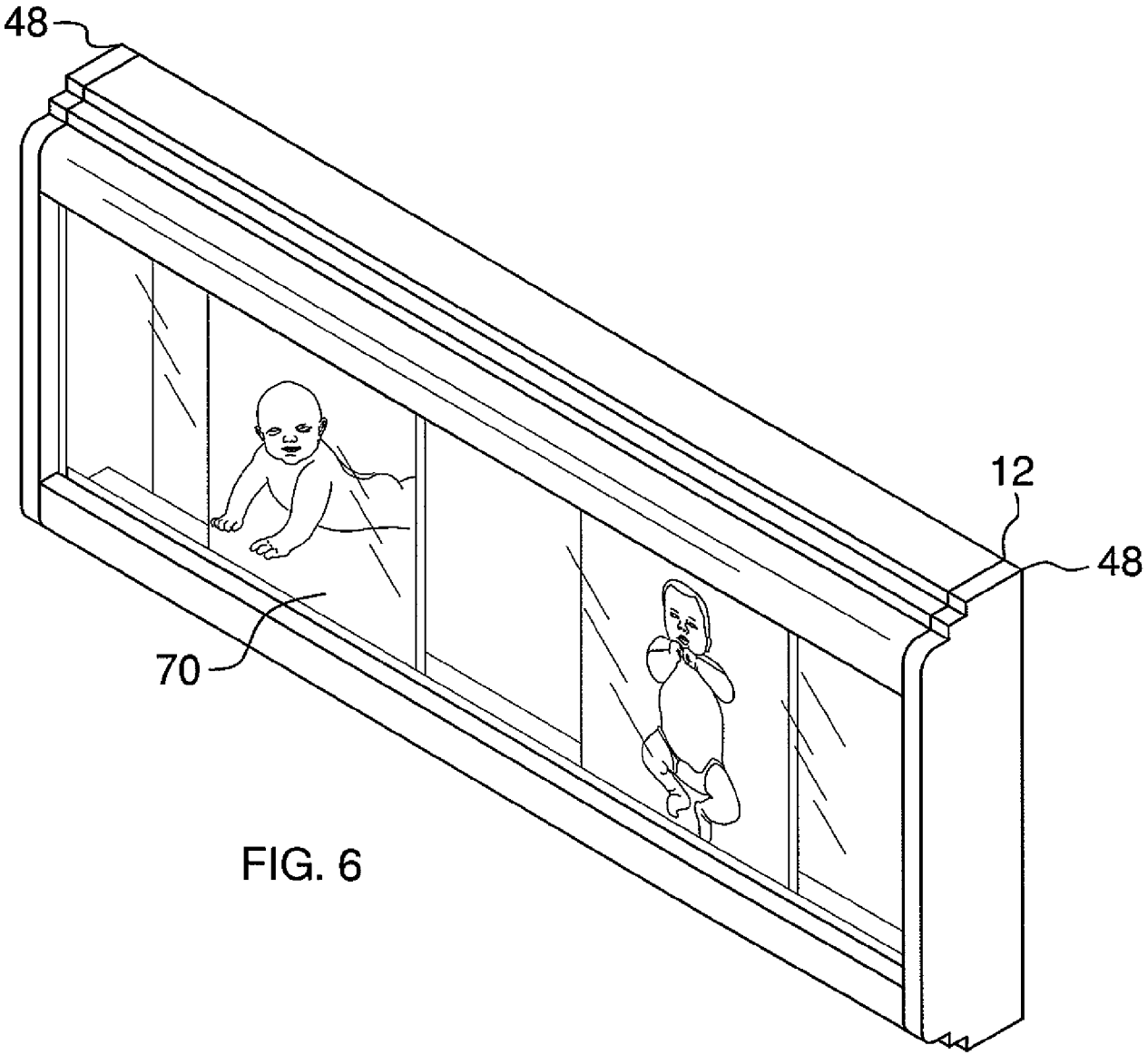
FIG. 6 is an in-use front perspective view of a housing of the present invention.
Figure 7:
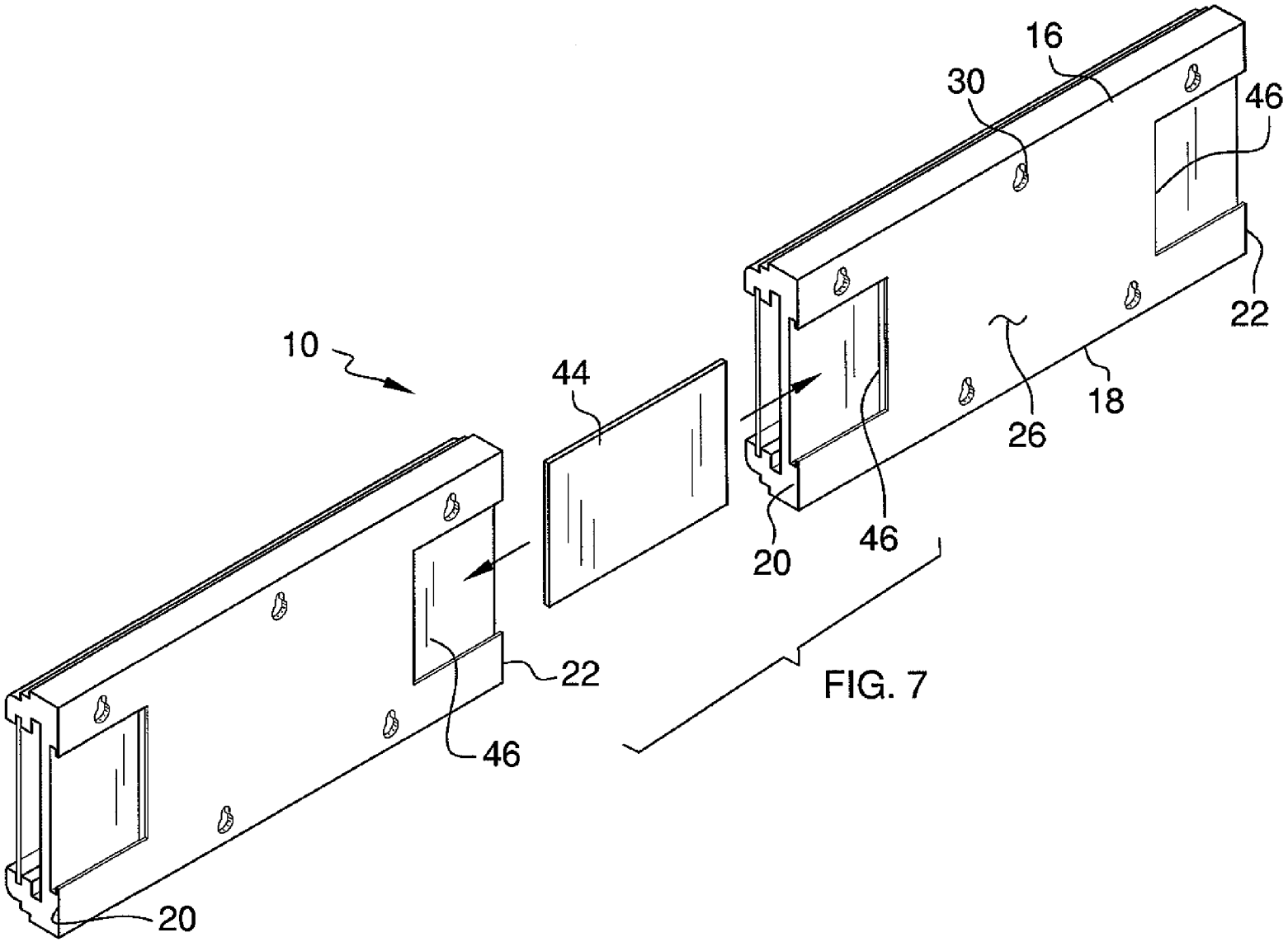
FIG. 7 is a rear perspective view of the present invention.
Figure 8:
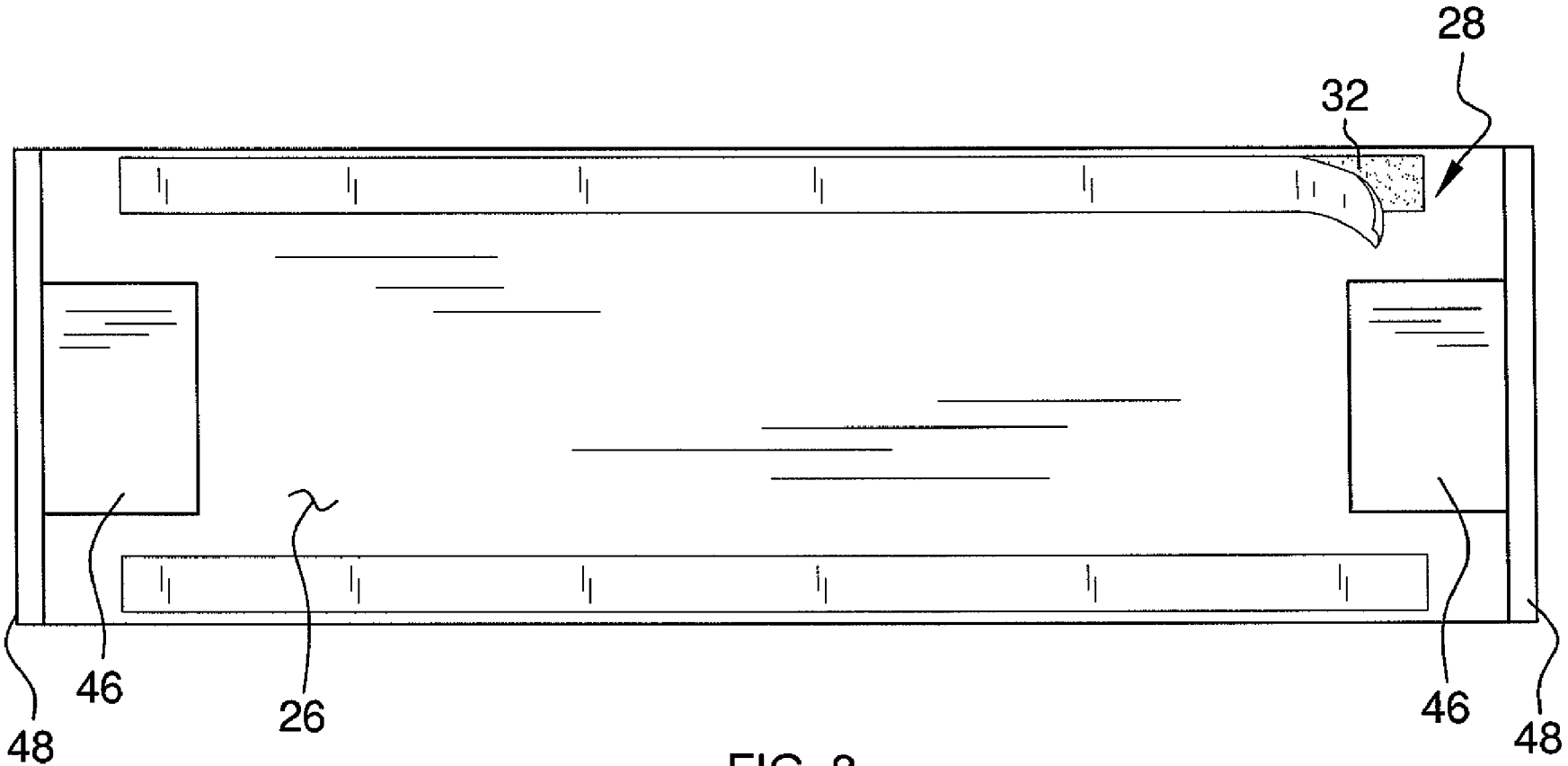
FIG. 8 is a rear view of an embodiment of the present invention.

With reference now to the drawings, and in particular to FIGS. 1 through 8 thereof, a new picture frame device embodying the principles and concepts of the present invention and generally designated by the reference numeral 10 will be described.

As best illustrated in FIGS. 1 through 8, the modular picture frame apparatus 10 generally comprises a plurality of housings 12. The housings 12 are configured to removably receive at least one picture 70. Each of the housings 12 includes a panel 14 that has a first edge 16, a second edge 18, a third edge 20, and a fourth edge 22. The first 16 and second 18 edges are positioned opposite of each other and each of the third 20 and fourth 22 edges are positioned opposite of each other. The panel 14 may have a rectangular shape. The panel 14 has a front side 24 and a back side 26. The back side 26 includes at least one mounting member 28 to facilitate the mounting of the panel 14 on a wall. The first embodiment, shown in FIG. 3, includes wells 30 as mounting members 28 to receive fasteners extending into a wall. The second embodiment, shown in FIG. 8, includes pressure sensitive adhesive 32 to adhere the panel 14 to wall. Additionally, hooks, not shown, may be used as the mounting members 28.

Each of the housings 12 further includes an upper flange 34 that is attached to the front side 24 adjacent to and being coextensive with the first edge 16. A lower flange 36 is attached to the front side 24 adjacent to and being coextensive with the second edge 18. Each of the upper 34 and lower 36 flanges has an elongated slot 38 therein positioned adjacent to an associated front edge 40 thereof. A picture 70 is positionable in the slots 38 in the upper 34 and lower 36 flanges to removably position the picture 70 in front of the front side 24. A transparent covering 42, made of glass or plastic, extends between the upper 34 and lower 36 flanges. The slots 38 are positioned between the panel 14 and the covering 42.

At least one coupler 44 is provided for removably coupling together two of the housings 12 such that a third edge 20 of one of the housings 12 abuts and is attached to a fourth edge 22 of another one of the housings 12. The coupler 44 includes a plate extendable into aligned notches 46 extending into the housings 12. Each of the housings 12 has a pair of notches 46 therein extending into corresponding ones of the third 20 and fourth 22 edges. This allows a plurality of housings 12 to be attached together.

A pair of end caps 48 is provided. Each of end caps 48 is removably attached and covering one of the third 20 and fourth 22 edges and corresponding ends of associated ones of the upper 34 and lower 36 flanges. The end caps 48 each include an outer wall 50 and a raised portion 52 attached to one side of the outer wall 50. The raised portion 52 of each of the end caps 48 has a shape and size adapted to fit into an opening between the upper 34 and lower 36 flanges.

In use, pictures 70 are placed in the slots 38 and additional housings 12, as needed, may be attached together to form a lengthened housing. This will allow a user of the apparatus 10 to form a housing having a required length to hold as many pictures 70 as desired. The panels 14 are then mounted on a wall surface in one of the manners described above.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A picture frame apparatus comprising:

a plurality of housings, each of said housings being configured to removably receive at least one picture, each of said housings including;

a panel having a first edge, a second edge, a third edge, and a fourth edge, said first and second edges being positioned opposite of each other and each of said third and fourth edges being positioned opposite of each other, said panel having a front side and a back side, said back side being planar, said back side including at least one mounting member to facilitate the mounting of said panel on a wall;

an upper flange being attached to said front side adjacent to and being coextensive with said first edge;

a lower flange being attached to said front side adjacent to and being coextensive with said second edge, each of said upper and lower flanges having an elongated slot therein positioned adjacent to an associated front edge thereof, wherein a picture is positionable in said slots in said upper and lower flanges to removably position the picture in front of said front side; and at least one coupler for removably coupling together two of said housings such that a third edge of one of said housings is abutting and attached to a fourth edge of another one of said housings, said coupler including a plate extendable into aligned notches extending into said housings, each of said housings having a pair of notches therein extending into corresponding ones of said third and fourth edges, said notches being positioned between associated ones of said front and back sides.

2. The apparatus according to claim 1, wherein each of said housings further includes a transparent covering extending between said upper and lower flanges, said slots being positioned between said panel and said covering.

3. The apparatus according to claim 1, further including a pair of end caps, each of end caps being removably attached and covering one of said third and fourth edges and corresponding ends of associated ones of said upper and lower flanges.

4. A picture frame apparatus comprising:

a plurality of housings, each of said housings being configured to removably receive at least one picture, each of said housings including;

a panel having a first edge, a second edge, a third edge, and a fourth edge, said first and second edges being positioned opposite of each other and each of said third and fourth edges being positioned opposite of each other, said panel having a front side and a back side, said back side including at least one mounting member to facilitate the mounting of said panel on a wall;

an upper flange being attached to said front side adjacent to and being coextensive with said first edge;

a lower flange being attached to said front side adjacent to and being coextensive with said second edge, each of said upper and lower flanges having an elongated slot therein positioned adjacent to an associated front edge thereof, wherein a picture is positionable in said slots in said upper and lower flanges to removably position the picture in front of said front side;

a transparent covering extending between said upper and lower flanges, said slots being positioned between said panel and said covering;

at least one coupler for removably coupling together two of said housings such that a third edge of one of said housings is abutting and attached to a fourth edge of another one of said housings, said coupler including a plate extendable into aligned notches extending into said housings, each of said housings having a pair of notches therein extending into corresponding ones of said third and fourth edges, said notches being positioned between associated ones of said front and back sides; and a pair of end caps, each of end caps being removably attached and covering one of said third and fourth edges and corresponding ends of associated ones of said upper and lower flanges.

* * * * *